US007699040B2

(12) United States Patent
Serra et al.

(10) Patent No.: US 7,699,040 B2
(45) Date of Patent: Apr. 20, 2010

(54) CONTROL METHOD FOR A DIRECT INJECTION SYSTEM OF THE COMMON-RAIL TYPE PROVIDED WITH A SHUT-OFF VALVE FOR CONTROLLING THE FLOW RATE OF A HIGH-PRESSURE FUEL PUMP

(75) Inventors: Gabriele Serra, S. Lazzaro Di Savena (IT); Matteo De Cesare, Torremaggiore (IT)

(73) Assignee: Magneti Marelli Powertrain S.p.A., Corbetta (IT)

( * ) Notice: Subject to any disclaimer, the term of this patent is extended or adjusted under 35 U.S.C. 154(b) by 20 days.

(21) Appl. No.: 12/283,465

(22) Filed: Sep. 12, 2008

(65) Prior Publication Data

US 2009/0076711 A1 Mar. 19, 2009

(30) Foreign Application Priority Data

Sep. 13, 2007 (EP) ..... 07425565

(51) Int. Cl.
*F02M 1/00* (2006.01)
*F02M 55/02* (2006.01)

(52) U.S. Cl. ..... 123/445; 123/456

(58) Field of Classification Search ..... 123/445, 123/446, 456, 457, 458; 701/101, 103, 104, 701/105, 112
See application file for complete search history.

(56) References Cited

U.S. PATENT DOCUMENTS 7,261,087 B2 * 8/2007 Ricco et al. ..... 123/446
7,603,986 B2 * 10/2009 Ricco et al. ..... 123/457
2009/0105929 A1 * 4/2009 Serra et al. ..... 701/103
2009/0139489 A1 * 6/2009 Serra et al. ..... 123/456

FOREIGN PATENT DOCUMENTS

DE 103 30 466 B3 10/2004
DE 10 2006 000 321 A1 1/2007
EP 1 357 285 A2 10/2003
EP 1 674 716 6/2006

* cited by examiner

*Primary Examiner*—John T Kwon
(74) *Attorney, Agent, or Firm*—Ohlandt, Greeley, Ruggiero & Perle, L.L.P

(57) ABSTRACT

A control method of a direct injection system of the common-rail type; the control method contemplates: feeding the pressurized fuel to a common rail by means of a high-pressure pump which receives the fuel through a shut-off valve; cyclically controlling the opening and closing of the shut-off valve for choking the flow rate of fuel taken in by the high-pressure pump; driving the shut-off valve synchronously with respect to the mechanical actuation of the high-pressure pump by means of a driving frequency of the shut-off valve having a constant integer synchronization ratio, predetermined according to the pumping frequency of the high-pressure pump; estimating a perturbation intensity of the fuel pressure inside the common rail; and varying the phase of the commands of the shut-off valve with respect to the phase of the mechanical actuation of the high-pressure pump if the perturbation intensity of the fuel pressure inside the common rail is higher than a predetermined threshold value.

6 Claims, 1 Drawing Sheet

CONTROL METHOD FOR A DIRECT INJECTION SYSTEM OF THE COMMON-RAIL TYPE PROVIDED WITH A SHUT-OFF VALVE FOR CONTROLLING THE FLOW RATE OF A HIGH-PRESSURE FUEL PUMP

The present invention relates to a control method of a direct injection system of the common-rail type provided with a shut-off valve for controlling the flow rate of a high-pressure fuel pump.

BACKGROUND OF THE INVENTION

In a direct injection system of the common-rail type, a high-pressure pump receives a flow of fuel from a tank by means of a low-pressure pump and feeds the fuel to a common rail hydraulically connected to a plurality of injectors. The pressure of the fuel in the common rail must be constantly controlled according to the engine point either by varying the instantaneous flow rate of the high-pressure pump or by constantly feeding an excess of fuel to the common rail and by discharging the fuel in excess from the common rail itself by means of an adjustment valve. Generally, the solution of varying the instantaneous flow rate of the high-pressure pump is preferred, because it displays a much higher energy efficiency and does not cause an overheating of the fuel.

In order to vary the instantaneous flow rate of the high-pressure pump, there has been suggested a solution of the type presented in patent application EP0481964A1 or in U.S. Pat. No. 6,116,870A1 which describe the use of a variable flow rate high-pressure pump capable of feeding the common rail only with the amount of fuel needed to maintain the fuel pressure within the common rail equal to the desired value; specifically, the high-pressure pump is provided with an electromagnetic actuator capable of varying the flow rate of the high-pressure pump instant-by-instant by varying the closing instant of an intake valve of the high-pressure pump itself.

Alternatively, in order to vary the instantaneous flow rate of the high-pressure pump, it has been suggested to insert a flow adjusting device upstream of the pumping chamber comprising a continuously variable section bottleneck which is controlled according to the required pressure within the common rail.

However, both the above-described solutions for varying the instantaneous flow rate of the high-pressure pump are mechanically complex and do not allow to adjust the instantaneous flow rate of the high-pressure pump with high accuracy. Furthermore, the flow rate adjustment device comprising a variable section bottleneck presents a small passage section in case of small flow rates and such small passage section determines a high local pressure loss (local load loss) which may compromise the correct operation of an intake valve which adjusts the fuel intake into a pumping chamber of the high-pressure pump.

For this reason, there has been suggested a solution of the type presented in patent application EP1612402A1, which relates to a high-pressure pump comprising a number of pumping elements operated in reciprocating motion by means of corresponding intake and delivery strokes and in which each pumping element is provided with a corresponding intake valve in communication with an intake pipe fed by a low-pressure pump. On the intake pipe there is arranged a shut-off valve controlled in a choppered manner for adjusting the instantaneous fuel flow rate fed to the high-pressure pump; in other words, the shut-off valve is a valve of the open/closed (on/off) type which is driven by modifying the ratio between the opening time and the closing time so as to vary the instantaneous fuel flow rate fed to the high-pressure pump. In this manner, the shut-off valve always displays an efficaciously wide passage section which does not determine an appreciable local pressure loss (local load loss).

The shut-off valve is controlled synchronously with respect to the mechanical actuation of the high-pressure pump (which is performed by a mechanical transmission which receives the motion from the crankshaft) by means of a driving frequency of the shut-off valve having a constant internal synchronization ratio, predetermined according to the pumping frequency of the high-pressure pump (typically, an opening/closing cycle of the shut-off valve is performed for each pumping stroke of the high-pressure pump). It has been observed that there is a rather narrow critical angle at each pumping of the high-pressure pump; if the opening command of the shut-off valve is given at the critical angle, irregularities in the fuel delivery to the high-pressure pump may occur and such delivery irregularities subsequently cause a perturbation of the fuel pressure inside the common rail.

In order to avoid sending the opening command of the shut-off valve at the critical pumping angle of the high-pressure pump, it has been suggested to phase the shut-off valve commands according to the pumpings of the high-pressure pump; however such a solution requires to accurately know the pumping phase of the high-pressure pump (i.e. the mechanical actuation phase of the high-pressure pump) and thus forces to install an angular encoder in the high-pressure pump with a considerable increase of the costs (an angular encoder is a very expensive sensor and is rather cumbersome).

Additionally, it is worth emphasizing that the mechanical transmission actuating the high-pressure pump receives the motion from the crankshaft and thus presents an actuation frequency proportional to the rotation speed of the crankshaft (consequently, by knowing the rotation speed of the crankshaft the actuation frequency of the mechanical transmission which actuates the high pressure pump is immediately known); however, due to construction and assembly limitations, the mechanical transmission which actuates the high-pressure pump cannot guarantee the respect of the predetermined phase with respect to the crankshaft and thus the phase between the mechanical transmission which actuates the high-pressure pump and the crankshaft cannot be know in advance.

SUMMARY OF THE INVENTION

It is the object of the present invention to provide a control method of a direct injection system of the common-rail type provided with a shut-off valve for controlling the flow rate of a high-pressure fuel pump, such a control method being free from the above-described drawbacks and, specifically, being easy and cost-effective to implement.

According to the present invention there is provided a control method of a direct injection system of the common-rail type provided with a shut-off valve for controlling the flow rate of a high-pressure fuel pump as claimed in the attached claims.

BRIEF DESCRIPTION OF THE DRAWING

The present invention will now be described with reference to the accompanying drawing illustrating a non-limitative embodiment thereof; specifically, the accompanying FIGURE is a diagrammatic view of an injection system of the common-rail type which implements the control method object of the present invention.

DETAILED DESCRIPTION OF THE INVENTION

Figure 1:
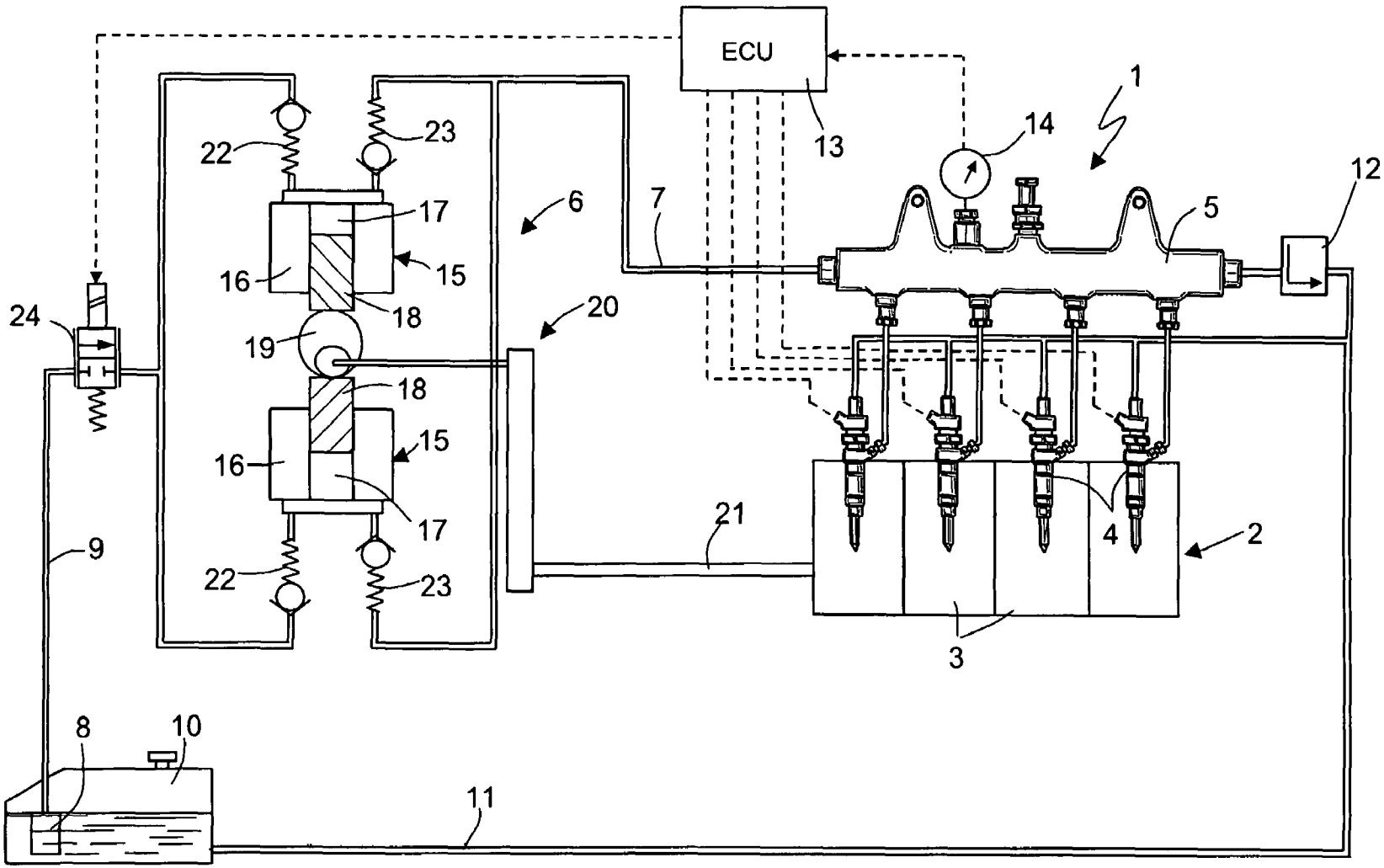

In the accompanying FIGURE, numeral 1 indicates as a whole a common-rail type system for direct fuel injection into an internal combustion engine 2 provided with four cylinders 3. The injection system 1 comprises four injectors 4, each of which presents a hydraulic needle actuation system and is adapted to inject fuel directly into a corresponding cylinder 3 of the engine 2 and to receive the pressurized fuel from a common rail 5.

A variable delivery high-pressure pump 6 feeds the fuel to the common rail 5 by means of a delivery pipe 7. In turn, the high-pressure pump 6 is fed by a low-pressure pump 8 by means of an intake pipe 9 of the high-pressure pump 6. The low-pressure pump 8 is arranged inside a fuel tank 10, onto which a discharge channel 11 of the fuel in excess of the injection system 1 leads, such a discharge channel 11 receiving the fuel in excess both from the injectors 4 and from a mechanical pressure limiting valve 12 which is hydraulically coupled to the common rail 5. The pressure-relief valve 12 is calibrated to open automatically when the pressure of the fuel inside the common rail 5 exceeds a safety valve which ensures the tightness and the safety of the injection system 1.

Each injector 4 is adapted to inject a variable amount of fuel into the corresponding cylinder 3 under the control of an electronic control unit 13. As previously mentioned, the injectors 4 have a hydraulic needle actuator and are thus connected to the discharge channel 11, which presents a pressure slightly higher than ambient pressure and leads upstream of the low-pressure pump 8 directly into the tank 10. For its actuation, i.e. for injecting fuel, each injector 4 draws a certain amount of pressurized fuel which is discharged into the discharge channel 11.

The electronic control unit 13 is connected to a pressure sensor 14 which detects the pressure of the fuel inside the common rail 5 and, according to the fuel pressure inside the common rail 5, controls in feedback the flow rate of the high-pressure pump 6; in this manner, the pressure of the fuel inside the common rail 5 is maintained equal to a desired value variable in time according to the engine point (i.e. according to the operating conditions of the engine 2).

The high-pressure pump 6 comprises a pair of pumping elements 15, each formed by a cylinder 16 having a pumping chamber 17, in which a mobile piston 18 slides in reciprocal motion pushed by a cam 19 actuated by a mechanical transmission 20 which receives the motion from a crankshaft 21 of the internal combustion engine 2. Each compression chamber 17 is provided with a corresponding intake valve 22 in communication with the intake pipe 9 and a corresponding delivery valve 23 in communication with the delivery pipe 7. The two pumping elements 15 are reciprocally actuated in phase opposition and therefore the fuel sent to the high-pressure pump 6 through the intake pipe 9 is only taken in by one pumping element 15 at a time which in that instant is performing the intake stroke (in the same instant, the intake valve 22 of the other pumping element 15 is certainly closed being the other pumping element 15 at compression phase).

Along the intake pipe 9 there is arranged a shut-off valve 24, which presents an electromagnetic actuation, is controlled by the electronic control unit 13 and is of the open/closed (on/off) type; in other words, the shut-off valve 24 may only assume either an entirely open position or an entirely closed position. Specifically, the shut-off valve 24 displays an efficacious and wide introduction section so as to allow to sufficiently feed each pumping element 17 without causing any pressure drop.

The flow rate of the high-pressure pump 6 is controlled only by using shut-off valve 24 which is controlled in chopped manner by the electronic control unit 13 according to the fuel pressure in the common rail 5. Specifically, the electronic control unit 13 determines a desired fuel pressure value inside the common rail 5 instant-by-instant according to the engine point and consequently adjusts the instantaneous fuel flow rate fed by the high-pressure pump 6 to the common rail 5 to follow the desired fuel pressure value inside the common rail 5 itself; to adjust the instantaneous fuel flow rate fed by the high-pressure pump 6 to the common rail 5, the electronic control unit 13 adjusts the instantaneous fuel flow rate taken in by the high-pressure pump 6 through the shut-off valve 24 by varying the ratio between the duration of the opening time and the duration of the closing time of the shut-off valve 24. In other words, the electronic control unit 13 cyclically controls the opening and the closing of the shut-off valve 24 to choke the fuel flow rate taken in by the high-pressure pump 6 and adjusts the fuel flow rate taken in by the high-pressure pump 6 by varying the ratio between the duration of the opening time and the duration of the closing time of the shut-off valve 24. By varying the ratio between the duration of the opening time and the duration of the closing time of the shut-off valve 24, the percentage of opening time of the shut-off valve 24 is varied with respect to the duration of the pump revolution of the high-pressure pump 6. During the opening time of the shut-off valve 24, the high-pressure pump 6 takes in the maximum flow rate which may cross the shut-off valve 24, while during the closing time of the shut-off valve 24 the high-pressure pump 6 does not take in anything; in this manner, it is possible to obtain an average pump revolution flow rate of the high-pressure pump 6 variable between a maximum value and zero.

It has been observed that in each pumping of the high-pressure pump 6 there is a rather narrow critical angle; if the opening command of the shut-off valve 24 is given at the critical angle, irregularities in the fuel delivery to the high-pressure pump 6 may occur and such delivery irregularities subsequently cause a perturbation of the fuel pressure inside the common rail 5.

According to a preferred embodiment, the electronic control unit 13 drives the shut-off valve 24 synchronously with respect to the mechanical actuation of the high-pressure pump 6 (which is performed by the mechanical transmission 20 which receives the motion from the crankshaft 21) by means of a driving frequency of the shut-off valve 24 having a constant integer synchronization ratio, predetermined according to the pumping frequency of the high-pressure pump 6 (typically, an opening/closing cycle of the shut-off valve 24 is performed for each pumping of the high-pressure pump 6).

The electronic control unit 13 cyclically estimates a perturbation intensity I of the fuel pressure inside the common rail 5 and varies the phase (i.e. the time/angle position of the shut-off valve 24 within each time/angle period) of the commands of the shut-off valve 24 with respect to the phase of the mechanical actuation of the high-pressure pump 6 if the perturbation intensity I of the fuel pressure inside the common rail 5 is higher than a predetermined threshold value. In this manner, the perturbation intensity I of the fuel pressure the inside the common rail 5 is used as signal (measure) of the fact that the opening commands of the shut-off valve 24 are being given at the critical angle. In other words, if the opening commands of the shut-off valve 24 are given at the critical angle, the electronic control unit 13 reveals this negative situation by evaluating the perturbation intensity I of the fuel pressure inside the common rail 5 and consequently acts by varying the phase of the commands of the shut-off valve 24 with respect to the mechanical actuation phase of the high-pressure pump 6.

According to a possible embodiment, the phase of the commands of the shut-off valve 24 is varied by a predetermined, constant amount if the perturbation intensity I is higher than the predetermined threshold value. According to an alternative embodiment, the phase of the commands of the shut-off valve 24 is varied by an amount depending on the perturbation intensity I if the perturbation intensity I itself is higher than the predetermined threshold value; typically, the phase of the commands of the shut-off valve 24 is varied by a greater amount proportionally to the difference between the perturbation intensity I and the predetermined threshold value. It is worth emphasizing that the electronic control unit 13 may indifferently control either the shut-off valve 24 by using either a time base (in this case, the phase of the commands of the shut-off valve 24 is varied by a certain range of time) or an angle base (in this case, the phase of the commands of the shut-off valve 24 is varied by a certain angle); the difference between the two control modes is minimum because angles and times are reciprocally linked by the rotation speed of the crankshaft 21 and in one engine revolution the instantaneous variation of the rotation speed of the crankshaft 21 is reduced and is, by first approximation, negligible.

Preferably, in an observation time window, the perturbation intensity I is supplied by an average quadratic deviation between the instantaneous values p(t) of the fuel pressure inside the common rail 5 and the average value $P_m$ in the observation time window of the fuel pressure in the common rail 5; in other words, the perturbation intensity I is given by the following equation:

$$I = \int_{t1}^{t2} (P_m - p(t))^2 \, dt$$

I perturbation intensity;

t1 initial instant of the observation time window;

t2 final instant of the observation time window;

$P_m$ average value of the observation time window of the fuel pressure in the common rail 5;

p(t) instantaneous fuel pressure variation values in the common rail 5.

Alternatively, in a time window of observation, the perturbation intensity I is given by the average quadratic deviation between the instantaneous values p(t) of the fuel pressure inside the common rail 5 and the target value $P_{target}$ of the fuel pressure in the common rail 5 in the observation time window:

$$I = \int_{t1}^{t2} (P_{target} - p(t))^2 \, dt$$

I perturbation intensity I;

t1 initial instant of the observation time window;

t2 final instant of the observation time window;

$P_{target}$ target value of the observation time window of the fuel pressure in the common rail 5;

p(t) instantaneous fuel pressure variation values in the common rail 5.

The above-described control strategy of the shut-off valve 24 presents many advantages because it allows to both effectively (i.e. with a high degree of success) and efficiently (i.e. with a minimum engagement of resources) ensure that the opening controls of the shut-off valve 24 are not given at the critical angle. Furthermore, the above-described control strategy of the shut-off valve 24 is cost-effective and simple to implement in a common-rail injection system, because it does not require the installation of any additional component with respect to those normally present.

According to a different embodiment from that described above, the electronic control unit 13 drives the shut-off valve 24 in asynchronous manner with respect to the mechanical actuation of the high-pressure pump 6 by means of a driving frequency of the shut-off valve 24 having a constant non-integer ratio, predetermined according to the pumping frequency of the high-pressure pump 6. In this manner, there is created a non-null slip between the command of the shut-off valve 24 and the mechanical actuation of the high-pressure pump 6; consequently, the position of the commands of the shut-off valve 24 varies continuously and cyclically with respect to the mechanical actuation of the high-pressure pump 6. According to this embodiment, the opening commands of the shut-off valve 24 given at the critical angle are a minor, non-significant fraction of all the opening commands of the shut-off valve 24.

For example, the slip between the command of the shut-off valve 24 and the mechanical actuation of the high-pressure pump 6 could be equal to approximately 1.05 (or 0.95) so that approximately only one opening command of the shut-off valve 24 is given at the critical angle every twenty opening commands of the shut-off valve 24. In this manner, the irregularities on the pressure of the fuel in the common rail 5 are very diluted and thus negligible.

The major advantage of the latter control strategy of the shut-off valve 24 is its simplicity and cost-effectiveness because no checking or adjustment operations are required. Furthermore, the latter control strategy of the shut-off valve 24 is cost-effective and simple to implement in a common-rail injection system, because it does not require the installation of any additional component with respect to those normally present.

The invention claimed is:

1. A control method of a direct injection system (1) of the common-rail type provided with a shut-off valve (24) for controlling the flow rate of a high-pressure fuel pump (6); the control method comprising the steps of:

feeding the pressurized fuel to a common rail (5) by means of a high-pressure pump (6) which receives the fuel through the shut-off valve (24);

cyclically controlling the opening and closing of the shut-off valve (24) for choking the flow rate of fuel taken in by the high-pressure pump (6);

adjusting the flow rate of fuel taken in by the high-pressure pump (6) by varying the ratio between the duration of the opening time and the duration of the closing time of the shut-off valve (24); and driving the shut-off valve (24) synchronously with respect to the mechanical actuation of the high-pressure pump (6) by means of a driving frequency of the shut-off valve (24) having a constant integer synchronization ratio, predetermined according to the pumping frequency of the high-pressure pump (6);

the control method is characterized in that it comprises the further steps of:

estimating a perturbation intensity (I) of the fuel pressure inside the common rail (5); and varying the phase of the commands of the shut-off valve (24) with respect to the phase of the mechanical actuation of the high-pressure pump (6) if the perturbation intensity (I) of the fuel pressure inside the common rail (5) is higher than a predetermined threshold value.

2. A control method according to claim 1, wherein the phase of the commands of the shut-off valve (24) is varied by a predetermined, constant amount if the perturbation intensity (I) is higher than the predetermined threshold value.

3. A control method according to claim 1, wherein the phase of the commands of the shut-off valve (24) is varied by an amount dependent from the perturbation intensity (I) if the perturbation intensity (I) itself is higher than the predetermined threshold value.

4. A control method according to claim 1, wherein in a time window of observation, the perturbation intensity (I) is given by the average quadratic deviation between the instantaneous values of the fuel pressure inside the common rail (5) and the average value in the observation time window of the fuel pressure in the common rail (5).

5. A control method according to claim 1, wherein in a time window of observation, the perturbation intensity (I) is given by the average quadratic deviation between the instantaneous values of the fuel pressure inside the common rail (5) and the target value in the observation time window of the fuel pressure in the common rail (5).

6. A control method of a direct injection system (1) of the common-rail type provided with a shut-off valve (24) for controlling the flow rate of a high-pressure fuel pump (6); the control method comprising the steps of:

feeding the pressurized fuel to a common rail (5) by means of a high-pressure pump (6) which receives the fuel through the shut-off valve (24);

cyclically controlling the opening and closing of the shut-off valve (24) for choking the flow rate of fuel taken in by the high-pressure pump (6);

adjusting the flow rate of fuel taken in by the high-pressure pump (6) by varying the ratio between the duration of the opening time and the duration of the closing time of the shut-off valve (24);

the control method is characterized in that it comprises the further step of driving the shut-off valve (24) asynchronously with respect to the mechanical actuation of the high-pressure pump (6) by means of a driving frequency of the shut-off valve (24) having a constant integer synchronization ratio, predetermined according to the pumping frequency of the high-pressure pump (6).

* * * * *